US007383972B2

(12) United States Patent
Keller

(10) Patent No.: US 7,383,972 B2
(45) Date of Patent: Jun. 10, 2008

(54) SLIDING CLOSING ELEMENT, WITH COUPLING

(75) Inventor: Werner Keller, Steinhausen (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 36 days.

(21) Appl. No.: 10/577,793

(22) PCT Filed: Oct. 22, 2004

(86) PCT No.: PCT/EP2004/011935

§ 371 (c)(1),
(2), (4) Date: Apr. 28, 2006

(87) PCT Pub. No.: WO2005/042190

PCT Pub. Date: May 12, 2005

(65) Prior Publication Data

US 2007/0029709 A1 Feb. 8, 2007

(30) Foreign Application Priority Data

Oct. 31, 2003 (CH) ..... 1863/03

(51) Int. Cl.
*C21C 5/42* (2006.01)

(52) U.S. Cl. ..... 222/600; 266/236

(58) Field of Classification Search ..... 222/600; 266/236

See application file for complete search history.

(56) References Cited

U.S. PATENT DOCUMENTS

| | | | |
|---|---|---|---|
| 4,596,345 A | 6/1986 | Beckers | |
| 6,045,015 A | 4/2000 | Waltenspuhl et al. | |
| 6,276,573 B1 * | 8/2001 | Tofuku et al. | 222/600 |

FOREIGN PATENT DOCUMENTS

| | | |
|---|---|---|
| EP | 0 110 028 A | 6/1984 |
| EP | 0 875 320 A | 11/1998 |

* cited by examiner

*Primary Examiner*—Scott Kastler
(74) *Attorney, Agent, or Firm*—Robert P. Michal; Frishauf, Holtz, Goodman & Chick, P.C.

(57) ABSTRACT

The invention relates to a sliding closing element, especially for an intermediate distributor or similar metallurgical containers. According to the invention, the mobile sliding plate of said closing element can be driven by means of a drive comprising a driving road and a push rod connected thereto. In order to ensure that the oscillatory movement of the sliding plate does not impair the connection during operation, a coupling arranged as a connecting body between the opposite ends of the push rod and the driving rod is provided with two coupling parts that engage in each other without play.

9 Claims, 2 Drawing Sheets

SLIDING CLOSING ELEMENT, WITH COUPLING

This application is a U.S. National Phase Application under 35 USC 371 of International Application PCT/EP2004/011,935 filed Oct. 10, 2004.

The invention concerns a sliding closing element, especially for an intermediate distributor or similar metallurgical containers, whose mobile sliding plate can be driven by means of a drive comprising a driving rod and a push rod connected thereto, With sliding closing elements of this kind it is known that the mobile sliding plate is set to oscillate continuously during operation by its drive, and that the driving rod and the push rod connected thereto are also subjected to this.

The connection between the push rod and the driving rod is realised with some play. This creates a risk that inaccuracies in the control will occur during operation due to the oscillating movement and the existing play, which will consequently influence the functionality of the sliding closing. In addition the coupling of the sliding plate to its driving organ is cumbersome in many cases.

It is the purpose of this invention to avoid these disadvantages and to offer a sliding closing element of the kind described above that is characterised by a controllable conforming connection between push rod and driving rod which is also easy and comfortable to operate.

This task is solved in accordance with the invention in that the connection is formed by a coupling located between the opposite ends of both rods with two coupling parts engaging each other without play.

In this way it is possible to always maintain a connection without play between the push rod and the driving rod during operation despite the oscillating movement of these parts. In addition the coupling of the mobile sliding plate to its driving organ is much simplified, as one only has to push the two couplings into each other to create the connection between push rod and driving rod of the sliding plate drive.

In the sense of a constructively simple, robust and compact construction it is envisaged according to the invention that the coupling is formed by a coupling head and a coupling claw received by form and force closure into the same, with a wedge shoe that is spring-biased transversely in relation to the driving direction of the driving rod and presses against the coupling head. Thanks to the form and force closure co-operation of the parts the coupling is always completely free of play.

It is of advantage from a construction point of view if the coupling head can consists of a component with a T-shaped cross-section comprising of a facing side engaging bridge and an adjacent middle bridge.

It is also of advantage from a construction point of view if the coupling claw consists of component with a U-shaped cross-section comprising of a facing wall, a rear wall, two side walls, and a floor plate, whereby the facing wall comprises a central receiving slot for the middle bridge of the coupling head, whilst the rear wall and the floor plate are equipped with support surfaces for the wedge shoe, i.e. for the springs tensioning the same.

In order to achieve an even spring tensioning of the wedge shoe the invention envisages that the wedge shoe is tensioned by two springs arranged symmetrically in relation to the longitudinal axis of the driving rod.

According to the invention the wedge shoe is held by means of set screw centrally inserted through the floor plate of the coupling claw, which is screwed into the wedge shoe.

By activating the set screw the installation position of the wedge shoe in the interior of the coupling claw can be adjusted precisely, and possible manufacturing or installation tolerances of the coupling components compensated.

In order to facilitate the coupling process it is useful to equip the abutting surfaces of both coupling parts with tapered edges.

For a comfortable coupling of the mobile sliding plate to its drive it is of advantage if the coupling head can be located on the push rod and the coupling claw in The driving rod.

Ideally the coupling head represents an integral part of the push rod, so that neither part will require additional connection elements.

For a fast and comfortable connecting of the driving rod with the coupling claw the same comprises a threaded bore in its rear wall, into which the projecting end of the driving rod is screwed.

The invention further envisages that the coupling installed inside the sliding closing element consists of a coupling claw and a coupling head with integrated push rod. In this way it is easily possible to retro-fit the coupling of this invention into existing sliding closing elements.

The invention will now be described in more detail with reference to an embodiment and the enclosed drawings, whereby:

Figure 1:
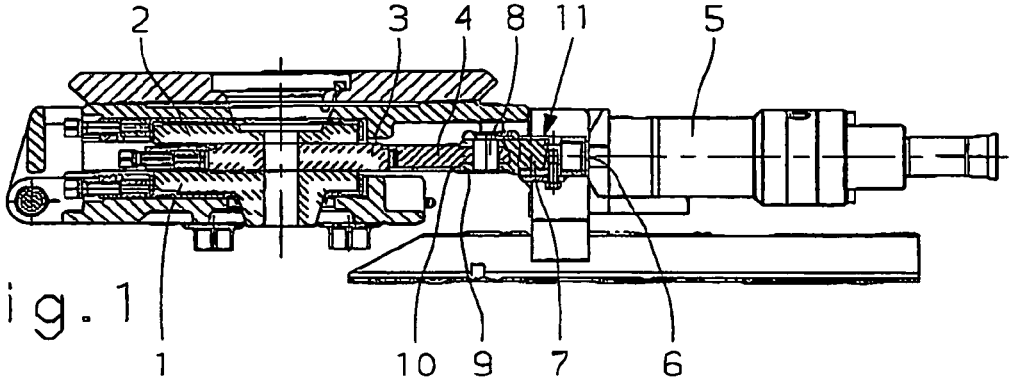
FIG. 1 shows a sliding closing element with a coupling of this invention between the push rod and the driving rod of the drive.
Figure 2:
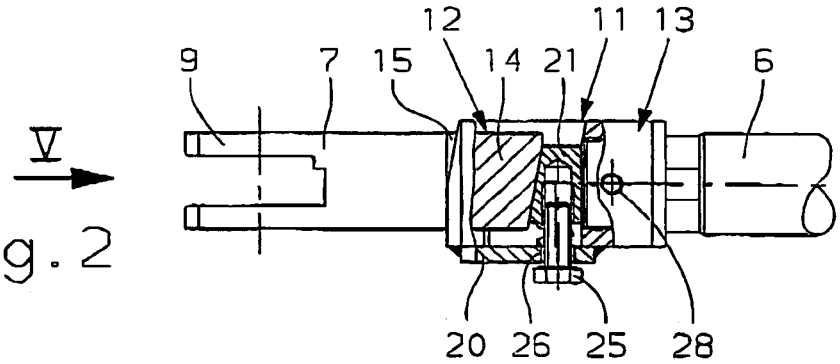
FIG. 2 shows a side view of the coupling illustrated-in FIG. 1 partially in cross-section and enlarged.

The sliding closing element shown in FIG. 1 comprises two locationally fixed sliding plates 1, 2 at an intermediate distributor not shown in detail, as well as a mobile sliding plate 3 positioned between the same, which is tensioned inside a sliding plate frame 4. The latter can be driven by means of a hydraulic cylinder 5 whose driving rod 6 is connected with a push rod 7 affixed to the sliding plate frame 4 together with the mobile sliding plate 3. The same is fitted with a bolt 8 which projects through a forked head 9 of the push rod 7 and a shoulder 10 of the sliding plate frame 4 projecting into the forked head 9.

The connection between the driving rod 6 and push rod 7 is created by means of a coupling 11 which is equipped with a coupling head 12 and a coupling claw 13 being received by means of form and force closure by the same.

The coupling head 12 consists of a component with a T-shaped cross-section integrated into the push rod 7 which comprises a facing side engaging bridge 14 and a middle bridge 15.

The coupling claw 13 on the other hand consists of a component with a U-shaped cross-section which comprises a facing wall 16, a rear wall 17, two side walls 18, 19 as well as a floor plate 20. Inside the same a wedge shoe 21 is located, which is tensioned by means of two springs 22*a*, 22*b* transversely in relation to the driving direction of the driving rod 6 and supported against the rear wall 17 of the coupling claw 13. The springs 22*a*, 22*b* are supported symmetrically in relation to the longitudinal axis of the driving rod 6 within blind bores 23*a*, 23*b* of the wedge shoe 21 and supported against the floor plate 20 of the coupling claw 13. In the facing wall 16 a central receiving slot 24 for the middle bridge 15 of the coupling head 12 is envisaged.

The wedge shoe 21 is held by means of a set screw 25 which projects through a bore 26 in the floor plate 20 centrally between the springs 22*a*, 22*b*. The set screw 25 can be screwed into the wedge shoe 21 more or less deeply in such a way that the same will not contact the floor plate 20 during operation, so that the height of the wedge shoe 21 can be adjusted transversely to the displacement direction. In the meantime the wedge shoe 21 can be positioned by means of this set screw 25 during assembly until the coupling is created without play. During assembly however the set screw 25 can be screwed in, and the wedge shoe 21, and with that the coupling 11, therefore released from its force closure.

The rear wall 17 of the coupling claw 13 comprises a centrally located threaded bore 27 into which the projecting end of the driving rod 6 is screwed. In addition an anti-rotation pin 28 is envisaged in the coupling claw 13, the same projecting into a longitudinal groove 29 of the driving rod 6.

Figure 3:
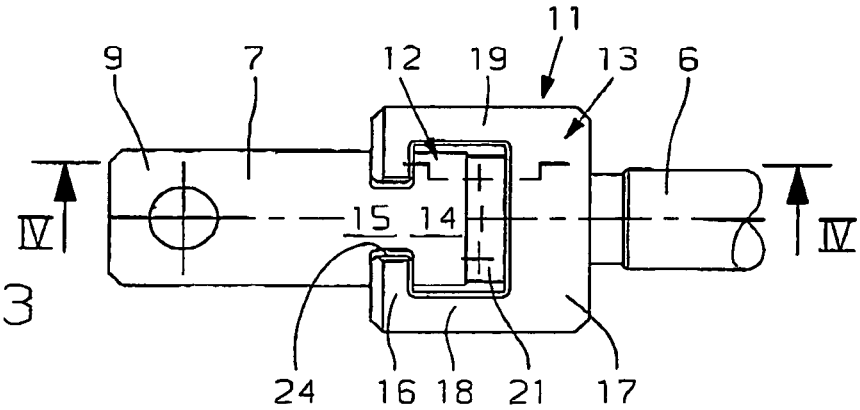
FIG. 3 shows an overview of the coupling illustrated in FIG. 1, also enlarged.
Figure 4:
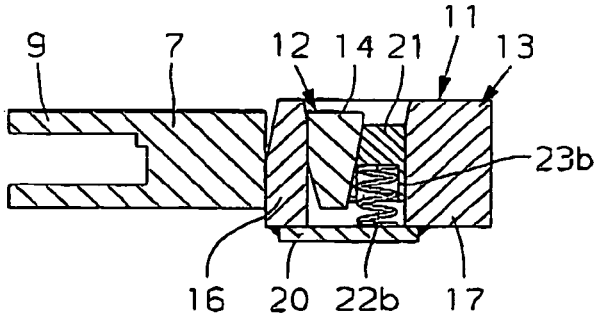
FIG. 4 shows a cross-sectional view of the coupling along the line IV-IV of FIG. 3.
Figure 5:
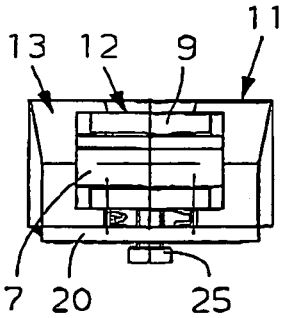
FIG. 5 shows a view of the coupling in the direction of the arrow V of FIG. 2.
Figure 7:
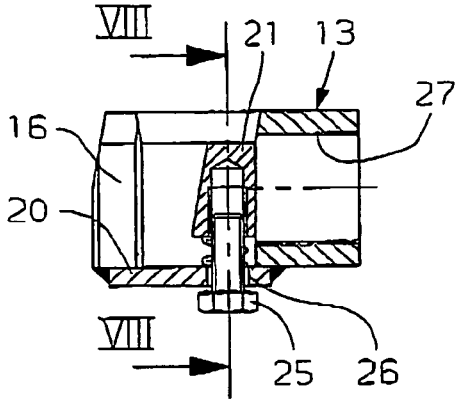
FIG. 7, shows a cross-section of the coupling claw along the line VII-VII of FIG. 6.
Figure 8:
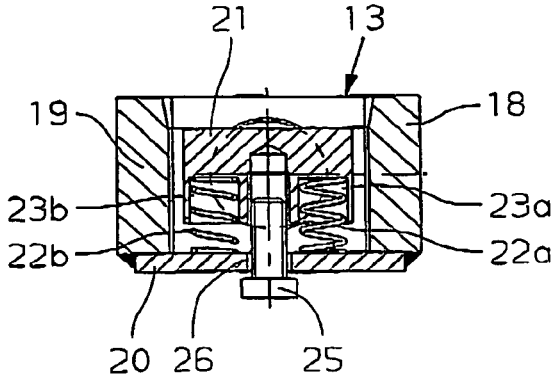
FIG. 8 shows a cross-section of the coupling claw along the line VIII-VIII of FIG. 7.
Figure 6:
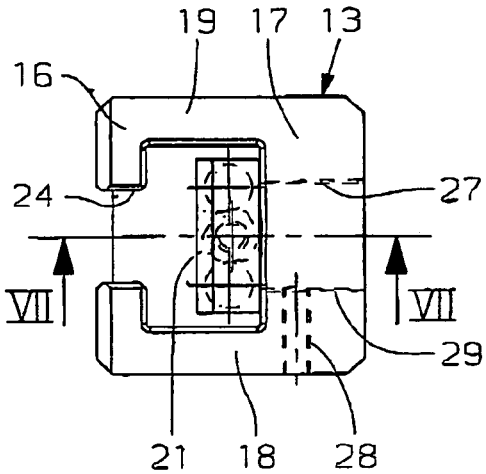
FIG. 6 shows an enlarged overview of the coupling claw of the coupling illustrated in FIG. 1.
Figure 9:
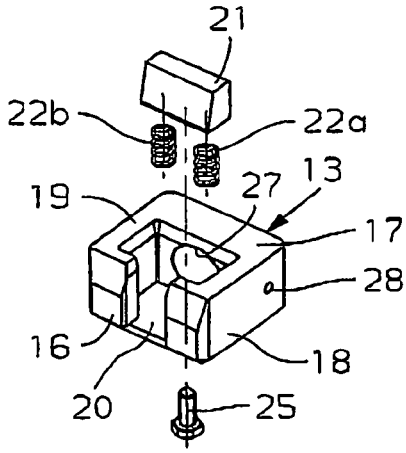
FIG. 9 shows an exploded view of the coupling claw illustrated in FIG. 6.
Figure 10:
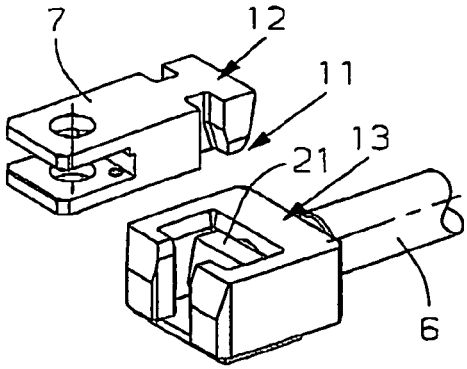
FIG. 10 shows the coupling illustrated in FIG. 2 also in the form of an exploded drawing.

It is clear from FIG. 3 that the middle bridge 15 of the coupling head 12 is received into the receiving slot 24 of the coupling claw 13 by means of form closure. Thanks to the pressure of the wedge shoe 21 against the engaging bridge 14 of the coupling head 12 a clamping effect free from play simultaneously results between both parts. In this way a form as well as a force closure connection is created between the coupling head 12 and the coupling claw 13, and therefore between the push rod 7 and the driving rod 6.

The described coupling 8 forms a construction assembly consisting of the coupling claw 13 and the coupling head 12 with integrated push rod 7 which can be retrofitted into conventional sliding closing elements. For this is it necessary only to screw the coupling claw 13 to the driving rod 6 and to connect the push rod 7 with the sliding plate frame 4 by means of the bolt 8. The coupling is realised by inserting the coupling head 12 into the coupling claw 13. In order to facilitate this operation the edges of the abutting surfaces of the coupling parts 12 and 13 are tapered.

The invention has been sufficiently described with reference to the embodiment. It could however also be envisaged differently. It would for example be possible to provide only one spring 22.

The invention claimed is:

1. A sliding closing element for an intermediate distributor or similar metallurgical container, comprising:

a mobile sliding plate which can be driven by means of a drive comprising a driving rod and a push rod connected thereto, wherein the connection between the driving rod and the push rod is formed by a coupling arranged between opposite ends of the driving rod and push rod with two coupling parts that engage each other without play, wherein the coupling comprises a coupling head and a coupling claw that is received into the same by means of form and force closure, with a wedge shoe spring tensioned transversely in relation to a driving direction of the driving rod and supported against the wedge shoe pressing against the coupling head.

2. The sliding closing element according to claim 1, wherein the coupling head comprises a component with a T-shaped crosssection that includes a facing side engaging bridge and an adjacent middle bridge.

3. A sliding closing element comprising a coupling claw including a component with a U-shaped cross-section comprising a facing wall, a rear wall, two side walls and a floor plate, whereby the facing wall includes a central receiving slot for a middle bridge of a coupling head, and the rear wall and the floor plate are equipped with support surfaces for a wedge shoe, wherein the wedge shoe is tensioned by at least one spring arranged along a longitudinal axis of the driving rod.

4. The sliding closing element according to claim 3, wherein the wedge shoe is connected with a set screw inserted through the centre of the floor plate of the coupling claw, which does not contact the floor plate during operation, so that the height of the wedge shoe can be adjusted transversely in relation to the driving direction.

5. The sliding closing element according to claim 4, wherein the wedge shoe is maintainable in position by the set screw during coupling until the specific coupling is complete, whereas the set screw can be screwed in further during de-coupling, whereby the wedge shoe, and with it the coupling, can be disconnected.

6. The sliding closing element according to claim 5, wherein the abutting surfaces of the coupling head and the coupling claw include tapered edges.

7. The sliding closing element according to claim 6, wherein the coupling head includes an integrated part of the push rod.

8. A coupling for a sliding closing element according to claim 1, wherein the coupling is installable into the sliding closing element as a construction assembly including the coupling claw and the coupling head with the integrated push rod.

9. A coupling for a sliding closing element according to claim 3, wherein the coupling is installable into the sliding closing element as a construction assembly including the coupling claw and the coupling head with the integrated push rod.

* * * * *